US005368143A

United States Patent [19]

Pond et al.

[11] Patent Number: 5,368,143

[45] Date of Patent: Nov. 29, 1994

[54] CARRY-ON CASE HAVING A DETACHABLE WHEEL AND HANDLE ASSEMBLY

[75] Inventors: Gary E. Pond, South Bend, Ind.; Cecil E. Pond, Palm City, Fla.

[73] Assignee: Porter Case, Inc., South Bend, Ind.

[21] Appl. No.: 37,620

[22] Filed: Mar. 24, 1993

Related U.S. Application Data

[63] Continuation-in-part of Ser. No. 858,174, Mar. 27, 1992, abandoned, which is a continuation-in-part of Ser. No. 676,716, Mar. 29, 1991, Pat. No. 5,116,289.

[51] Int. Cl.[5] ..... A45C 5/14; A45C 9/00; A45C 13/26

[52] U.S. Cl. ..... 190/18 A; 190/115; 280/37; 280/655.1

[58] Field of Search ..... 190/18 A, 115, 117; 280/37, 47.17, 47.18, 47.26, 655.1

[56] References Cited

U.S. PATENT DOCUMENTS

| | | | |
|---|---|---|---|
| 905,759 | 12/1908 | Strauss | 190/18 A X |
| 3,063,730 | 11/1962 | Domoradzki | 280/47.18 X |
| 3,257,120 | 6/1966 | Browning | 190/18 A X |
| 3,462,171 | 8/1969 | Mitty et al. | 280/37 X |
| 3,522,955 | 8/1970 | Warner, Jr. | 190/18 A X |
| 3,550,997 | 12/1970 | Strand | 280/47.18 X |
| 3,790,513 | 1/1973 | Cassimally | 280/37 |
| 3,960,252 | 6/1976 | Cassimally | 280/37 X |
| 4,087,102 | 5/1978 | Sprague | 280/37 |
| 4,254,850 | 3/1981 | Knowles | 190/18 A |
| 4,261,447 | 4/1981 | Arias et al. | 280/47.26 X |
| 4,273,222 | 6/1981 | Cassimally et al. | 190/18 A |
| 4,311,222 | 1/1982 | Castanier | 280/47.26 X |
| 4,335,896 | 6/1982 | Koffler et al. | 190/18 A X |
| 4,340,132 | 7/1982 | Cerna | 190/18 A |
| 4,637,626 | 1/1987 | Foss et al. | 280/43.17 X |
| 4,773,123 | 9/1988 | Yu | 280/37 X |
| 4,900,043 | 2/1990 | Kho | 190/18 A X |
| 5,024,455 | 6/1991 | Schrecongost | 190/18 A X |
| 5,116,289 | 5/1992 | Pond et al. | 190/18 A |
| 5,167,306 | 12/1992 | Carrigan, Jr. | 190/115 X |
| 5,188,381 | 2/1993 | Kho | 190/18 A X |

FOREIGN PATENT DOCUMENTS

| | | | |
|---|---|---|---|
| 2561601 | 9/1985 | France | 280/47.26 |
| 2657576 | 8/1991 | France | 280/47.18 |
| 551991 | 11/1958 | Italy | 280/47.26 |
| 2230747 | 10/1990 | United Kingdom | 280/47.26 |

*Primary Examiner*—Sue A. Weaver
*Attorney, Agent, or Firm*—James D. Hall

[57] ABSTRACT

An improved carry-on case having a built-in travel cart capable of being towed by itself or with several pieces of luggage. The handle of the cart can be retracted for convenient storage. The handle forms a part of a wheel assembly which can be selectively secured to the case having two positions to enable the case to be towed or used as a lift.

8 Claims, 16 Drawing Sheets

CARRY-ON CASE HAVING A DETACHABLE WHEEL AND HANDLE ASSEMBLY

CROSS-REFERENCE TO RELATED APPLICATIONS

This is a continuation-in-part of application Ser. No. 858,174, filed Mar. 27, 1992, now abandoned which is a continuation-in-part of application Ser. No. 07/676,716, filed Mar. 29, 1991, now U.S. Pat. No. 5,116,289.

FIELD OF THE INVENTION

This invention relates to a carry-on case and has specific but not limited application to a durable lightweight carry-on case having an improved built-in wheel and handle assembly for portable travel convenience.

BACKGROUND OF THE INVENTION

The conventional carry-on case is typically a hand-carried travel case. Such cases are usually carried by a handle. It is generally necessary that this type of case be carried throughout an airport from places of departure to airplanes, from airplanes to airplanes, and from airplanes to places of arrival. For such cases there is provided a wheeled frame which is separately carried in addition to the carry-on case. The frame serves as a cart onto which the case can be strapped for transport. There are also cases that include incorporated handles and wheels so that the cases can be pulled by the handles, thereby permitting them to be towed about and transported throughout the airport. A problem with these prior art carry-on cases exists in that it is impractical, if not impossible, to use these cases as a support upon which to stack additional pieces of luggage without special devices or attachment hooks.

The present invention overcomes the above stated deficiencies of the prior art.

SUMMARY OF THE INVENTION

The carry-on case of this invention serves to alleviate the problem and inconvenience of transporting cumbersome luggage cases. This case contains a storable built-in handle which can function as a luggage travel cart by which the case can be pulled. This case can also be used to carry additional pieces of luggage stacked on top of the case, thereby permitting such pieces of luggage to be transported at one time.

It is therefore an object of this invention to provide for a novel carry-on case.

Another object of this invention is to provide for a case with wheels and a built-in handle functioning as a travel cart.

Another object of this invention is to provide for a case with wheels and a built-in collapsible handle that can be used to carry stacked luggage.

Other objects of the invention will become apparent upon a reading of the following description taken with the accompanying drawings.

BRIEF DESCRIPTION OF THE PREFERRED EMBODIMENTS

Figure 1:
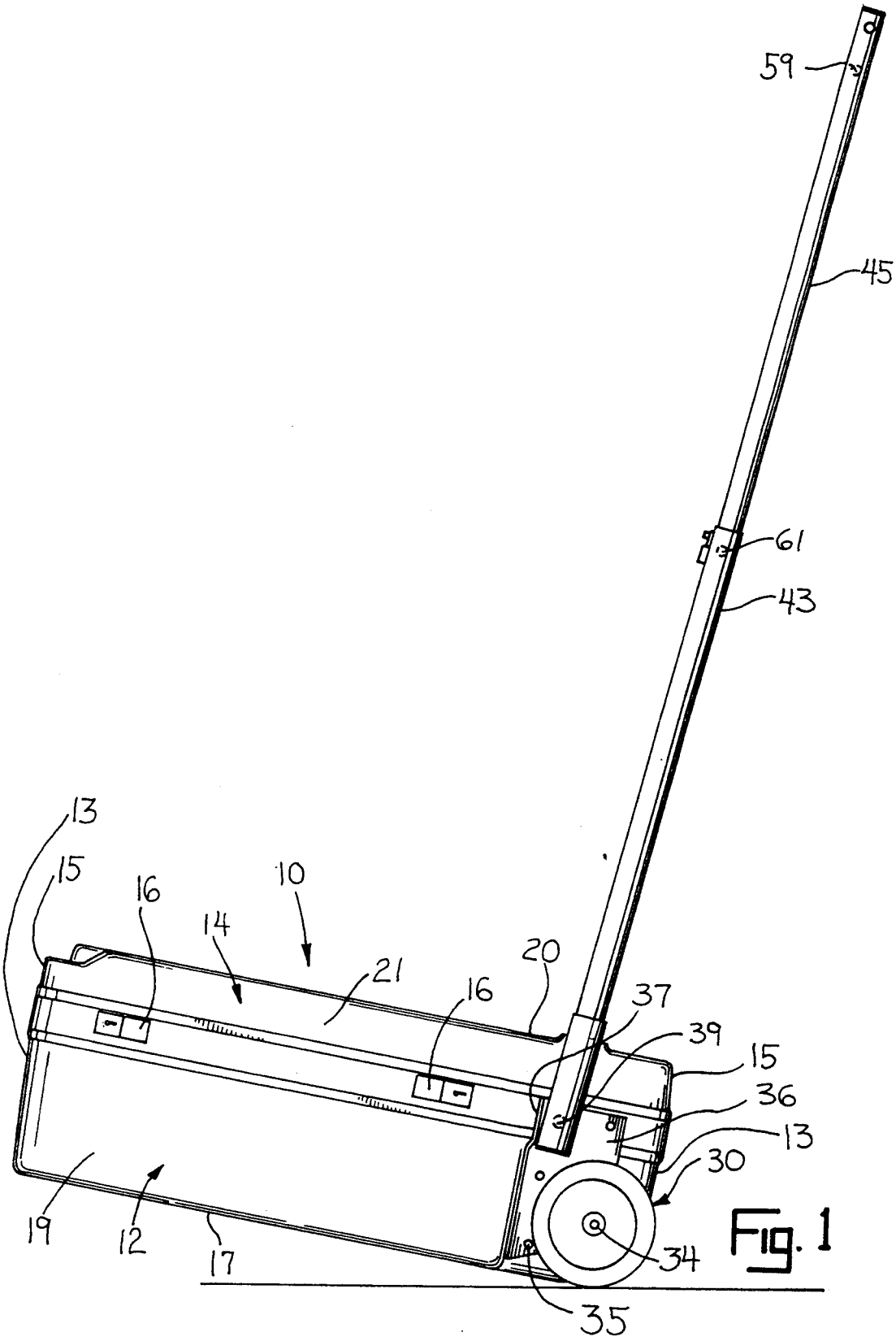
FIG. 1 is a perspective view of the carry-on case of this invention having a built-in travel cart with the handle raised and extended positions and tilted about its wheels.

The preferred embodiments illustrated are not intended to be exhaustive, or to limit the invention to the precise forms disclosed. They are intended to assist one skilled in the art to best utilize the invention.

Case 10 is illustrated in FIGS. 1–6 and includes a housing formed by a base 12 and a lid 14 both of which are connected and held together by rear hinges 25. Case 10 also includes two wheels 30 and a handle 40 that is releasably extendable, collapsible, lowerable and raisable.

Figure 2:
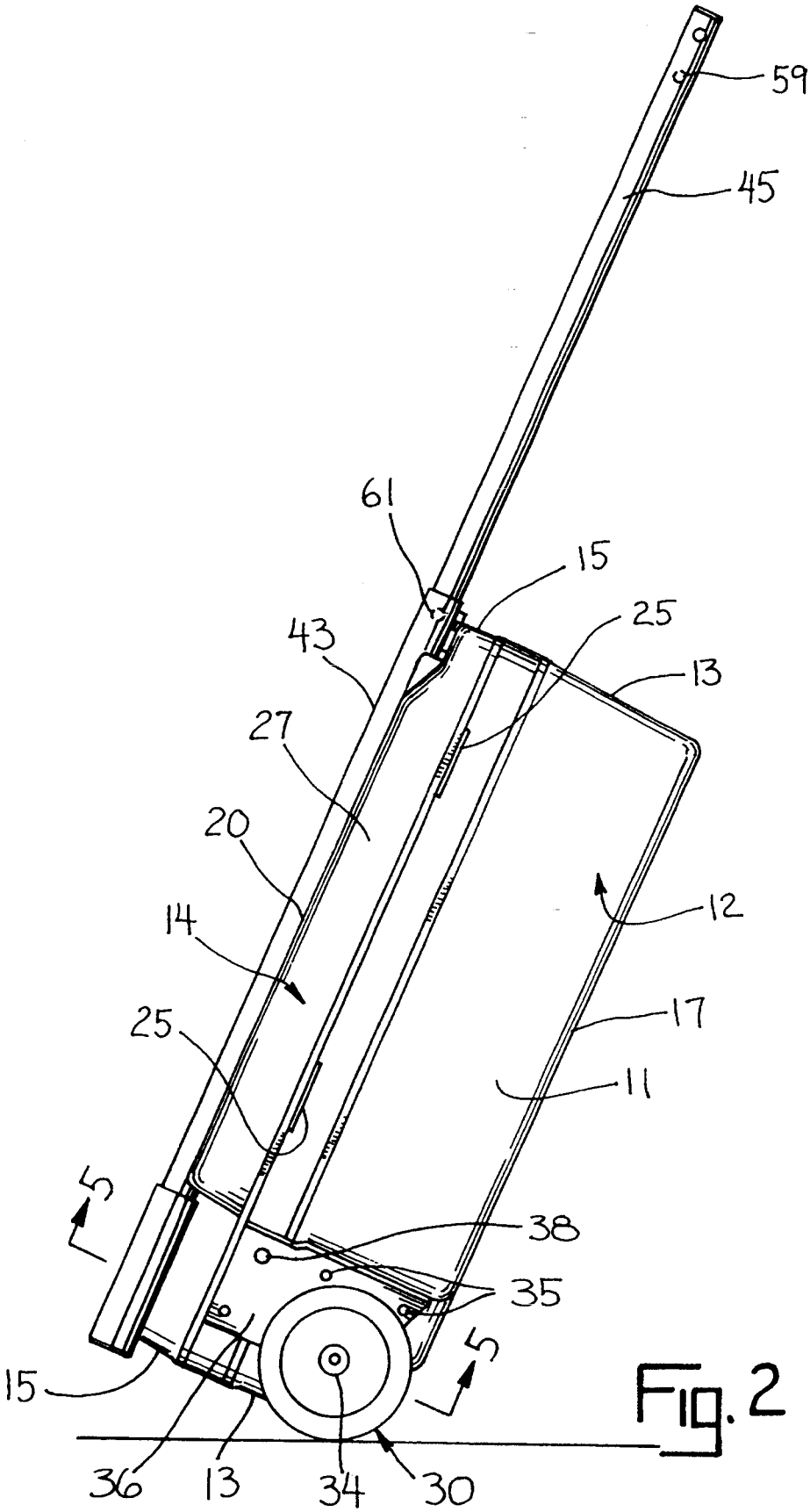
FIG. 2 is a perspective view of the carry-on case of this invention which shows the case in a tilted position about its wheels with the handle in its extended and lowered positions.
Figure 3:
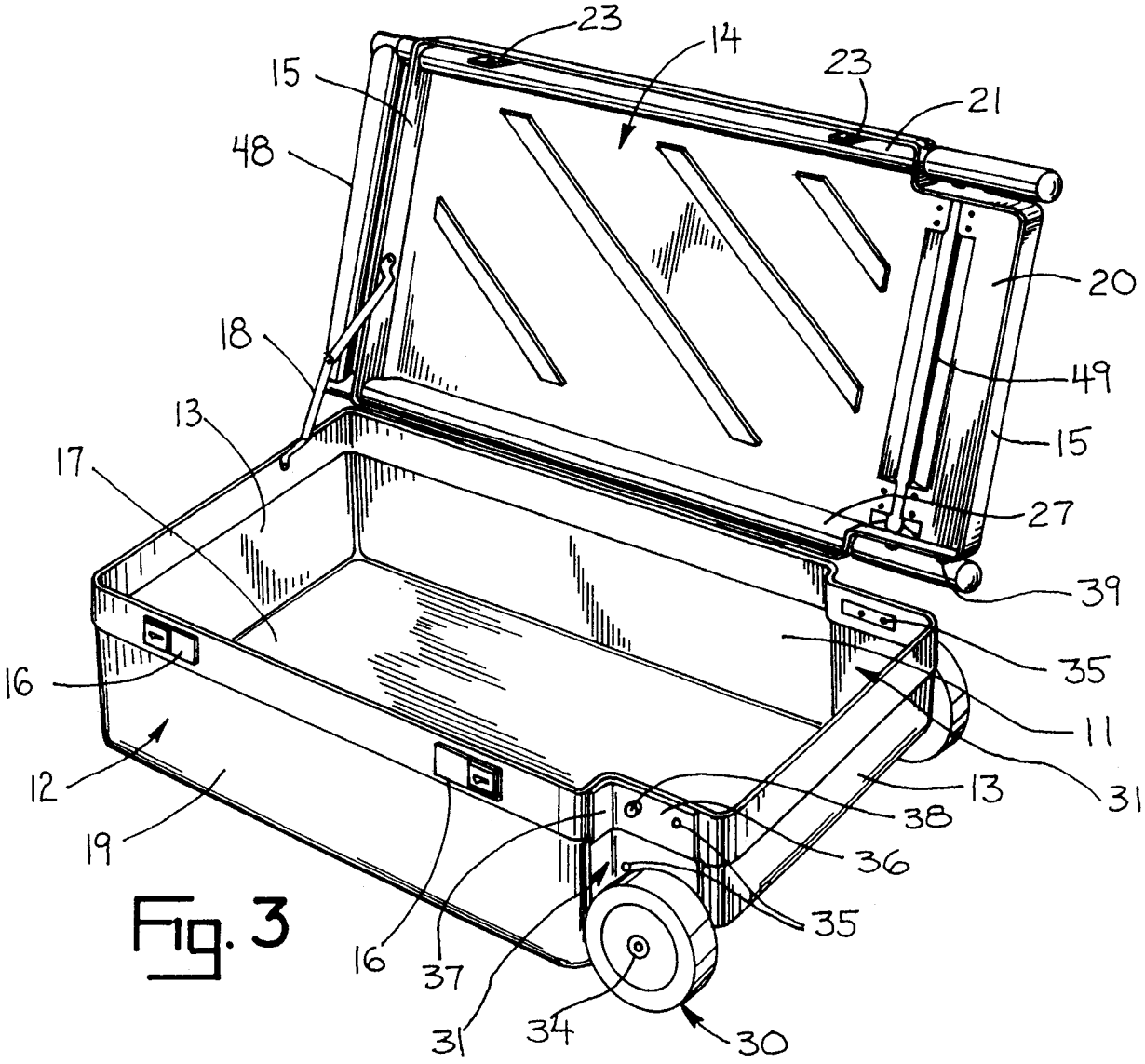
FIG. 3 is an elevational view of the carry-on case with the lid in an open position and with the handle in its lowered and collapsed positions.

Base 12 of case 10 includes a bottom wall 17, two end walls 13, a rear wall 11 and a front wall 19. Front wall 19 carries locks 16. Lid 14 is shiftable about hinges 25 from an open position as shown in FIG. 3 to a closed position as illustrated in FIGS. 1–2. When in its open position, lid 14 is supported and held open by a hinged lid holder 18. Lid 14 also includes a top wall 20, two end walls 15, a rear wall 27 and a front wall 21. Front wall 21 includes latches 23 which interlock with locks 16 to secure lid 14 in a closed position over base 12.

Wheels 30 are positioned on opposite sides of base 12 in indentations 31 formed in each wall 11 and 19. Wheels 30 are journalled upon an axle member 32 which extends along the bottom wall 17 of base 12. Axle member 32 extends through each wheel at its center with the wheels being retained upon the axle member by press-fitted retainer cups 34. Axle member 32 is secured to base 12 by extending through wheel plates 36. Wheel plates 36 are secured to base walls 11 and 19 within indentations 31 by fasteners 35.

Handle 40 of case 10 is releasably extendable, collapsible, lowerable and raisable as shown in FIGS. 1–6. Handle 40 includes two parallel side rails. Each side rail includes an outer telescopic member 43 and an inner telescopic member 45. Outer telescopic members 43 are joined at corresponding ends by a cross brace 50 and at their opposite corresponding ends by a pivot rod 44.

Figure 4:
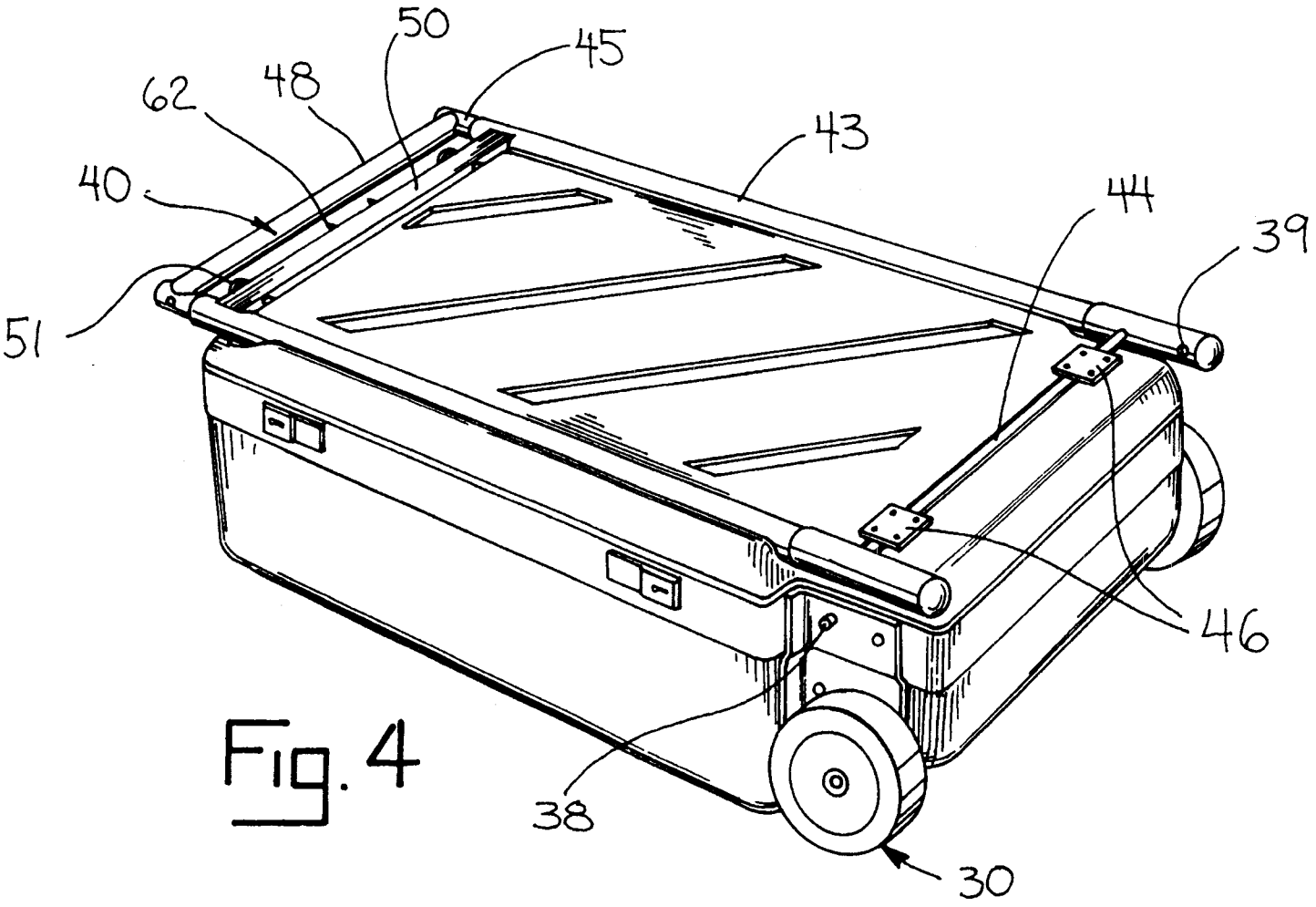
FIG. 4 is an elevational view of the carry-on case with the lid in a closed position and with the handle in its lowered and collapsed positions.
Figure 8:
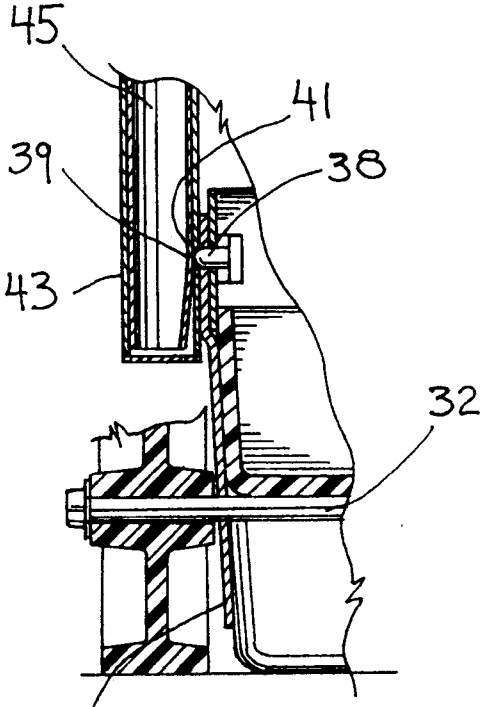
FIG. 8 is a fragmentary sectional view of the handle shown in its raised and collapsed positions.

Pivot rod 44 as shown in FIGS. 3–4 is retained in a transverse channel 49 formed in lid 14 by hold down plates 46 which are attached to lid 14 by rivets or other suitable fastening means. Pivot rod 44 is rotatable about its axis within channel 49 to permit handle 40 to be moved from the lowered position shown in FIG. 4 to a raised position when the lid 14 is closed as shown in FIGS. 1–2. When in its raised position, the handle preferably abuts outturned flange 37 of each plate 36 in an over-center orientation. A spring biased pin 38 extends into an opening 39 at the pivoted end of each outer telescopic member 43 to secure the handle in its raised position. To lower handle 40, the inner telescopic members 45 are first collapsed to cause bevelled end 41 of each inner telescopic member 45 to engage the protruding pin 38 and cam the pin sufficiently out of opening 39 in the outer telescopic member 43 to allow pivotal movement of the handle.

A hand grip 48 is connected to inner telescopic members 45 of handle 40 at their free ends. The inner telescopic members 45 are shiftable relative to the outer telescopic members 43 to allow handle 40 to assume the collapsed position seen in FIGS. 3 and 4 and the extended position seen in FIGS. 1 and 2. The extension of the handle is accomplished by pulling out on hand grip 48.

Handle 40 is selectively secured in its collapsed position or extended position by means of a locking system which is housed in and carried by cross brace 50. This locking system includes two lock rods 58 which are oppositely extending and are axially aligned. Lock rods 58 are retained within cross brace 50 and protrude through guide holes 57 formed in the inside of outer telescopic members 43 and aligned lock holes 59 in the inner telescopic members 45. Each of the lock rods 58 can be retracted out of the lock holes 59 to permit the inner telescopic members 45 to shift relative to the outer telescopic members 43. This feature permits either extension or retraction of handle 40.

Lock rods 58 are normally urged outwardly to a protruding position relative to lock holes 59 by a helical spring 60. Each end of helical spring 60 extends about an inner end of a lock rod 58, abutted compressively against a transverse grip pin 62. Each grip pin 62 is press-fitted through a lock rod 58. The grip pins 62 extend outwardly through the cross brace 50 to an exposed position that is adjacent to hand grip 48 when the handle 40 is in its collapsed position. Shifting or squeezing together the exposed ends of grip pins 62 compresses helical spring 60 and draws lock rods 58 together to cause the outer ends of lock rods 58 to be withdrawn from lock holes 59 of the inner telescopic members 45, freeing handle 40 and permitting it to be extended.

To secure handle 40 in its extended position, the inner telescopic members 45 have formed at their opposite ends a second set of lock holes 61. As the inner telescopic members 45 are shifted and releasably extended, the lock rods 58 align with the lock holes 61 in inner telescopic members 45 to permit each of the lock rods 58 to be again urged by helical spring 60 into the inner lock holes to secure the handle 40 in its extended position as is shown in FIGS. 1–2.

Again, to release and collapse handle 40, the case user need only squeeze together with one hand transverse grip pins 62. This causes the lock rods 58 to be withdrawn from the lock holes 61 and allows the inner telescopic members 45 to be pushed into outer telescopic members 43 until rods 58 enter lock holes 59.

In its lowered and collapsed position as shown in FIGS. 3–4, it is necessary to secure handle 40 to case 10. This is accomplished by another locking system including two lock pins 52 which are retained by cross brace 50 and which include head parts 51 and shank parts 53. The head parts 51 extend outwardly from the cross brace 50 and rest against cross brace 50 next to hand grip 48. Each shank part 53 protrudes interiorally through openings in cross brace 50. A head part 51 located exteriorly of the cross brace is threaded onto one end of the shank part. The opposite end of the shank part protrudes outwardly from brace 50. A helical spring 54 extends about each lock pin shank part 53 and is compressed between brace 50 and a shoulder 63 on the shank part so as to urge the lock pin shank part toward a strike plate 56 attached to lid end wall 15 with head part 51 abutting the brace. The protruding end of each shank 53 is forced by spring 54 into a lock hole 55 in strike plate 56 to secure the handle in its lowered position.

To release handle 40 from its lowered position in order to allow the handle to pivot away from case 10 into its raised position, the user need only grasp the head parts 51 of lock pins 52 and pull. This causes the helical springs 54 to be compressed with the shanks 53 being withdrawn from the lock holes 55 in the strike plates 56.

Figure 5:
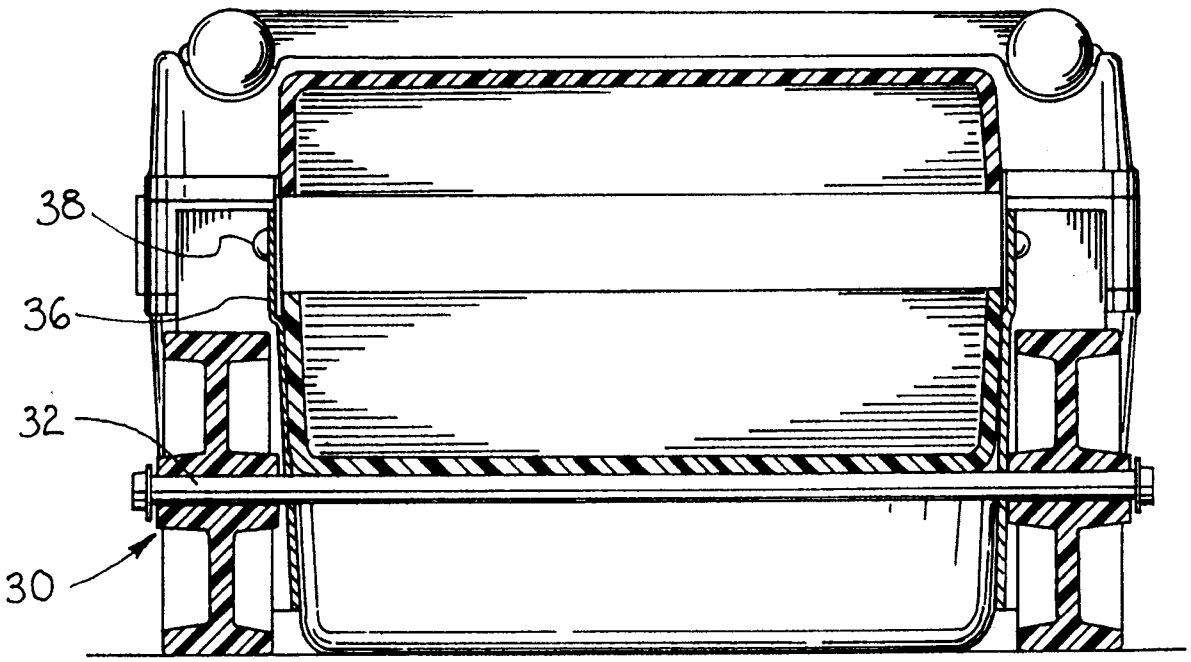
FIG. 5 is a sectional view seen along line 5—5 of FIG. 2.
Figure 7:
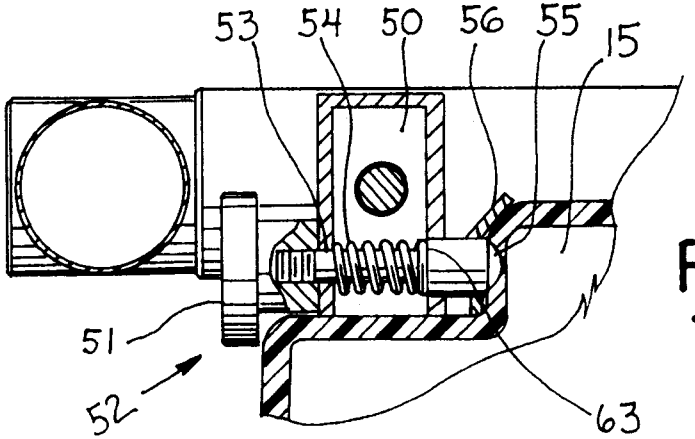
FIG. 7 is a fragmentary sectional view seen along line 7—7 of FIG. 6.
Figure 6:
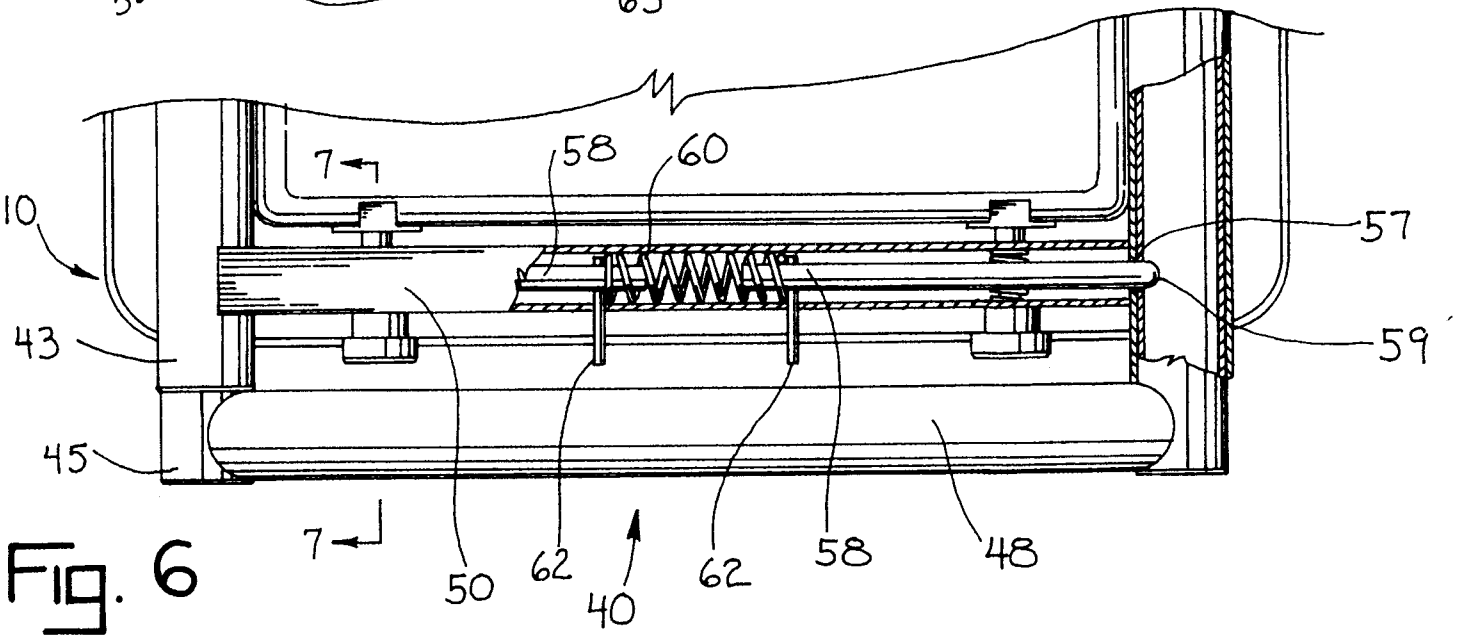
FIG. 6 is a fragmentary sectional view with positions removed to illustrate the securing and locking features of the handle.

When handle 40 is moved into its extended and raised position shown in FIG. 1, luggage composed of from 4 to 5 suitcases can be stacked upon the closed lid 14 and can rest against raised and extended handle 40. FIG. 2 illustrates a second towable orientation in which handle 40 is extended in its lowered position. In this position the case 10 can be pivoted upwards to permit towing. FIGS. 3–5 illustrate case 10 with handle 40 in its lowered and collapsed positions with handle 40 being usable as a grip to carry the case. Sufficient spacing is provided between grip 48 and brace 50 to allow the grip to be grasped by the hand of the user.

Case 10' illustrated in FIGS. 9–12 includes a housing formed by a base 12' and a lid 14' which are connected together by hinges 25'. Base 12' of case 10' includes a bottom wall 17', two end walls 13', a rear wall 11' and a front wall 19'. Bottom wall 17' includes two parallel recessed channels 60. Each channel 60 has a slotted lock hole located in the base of the channel. A U-shaped spring clamp 54 is also secured within each channel 60. Lid 14' includes a top wall 20' two end walls 15' a rear wall 27' and a front wall 21'. Case 10' also includes a wheel and handle assembly 70 that is entirely detachable and reattachable in different positions on base 12'.

Assembly 70 has two wheels 30'. Wheels 30' are journalled upon an axle member 32'. Wheels 30' are positioned on opposite sides of base 12' in indentations 31' formed in each wall 11' and 19'. Axle member 32' extends through each wheel 30' at its center with the wheels being retained upon the axle member by press-fitted retainer cups 34'.

Assembly 70 includes a handle 40' that is extendable and collapsible. Handle 40' of assembly 70 includes two parallel side rails. Each side rail includes an outer telescopic member 43' and an inner telescopic member 45'. Outer telescopic members 43' are Joined at corresponding ends by a cross brace 50' having grip pins 62'. Axle member 32' extends through the opposite corresponding ends of members 43'. A hand grip 48' is connected to inner telescopic members 45' of handle 40'. The movement of handle 40' between its extended position (as seen in FIGS. 10 and 11, and in broken lines in FIG. 12) and its collapsed position (as seen in FIGS. 9 and 12) is accomplished in the same manner as described above for case 10 of FIGS. 1–8.

Figure 9:
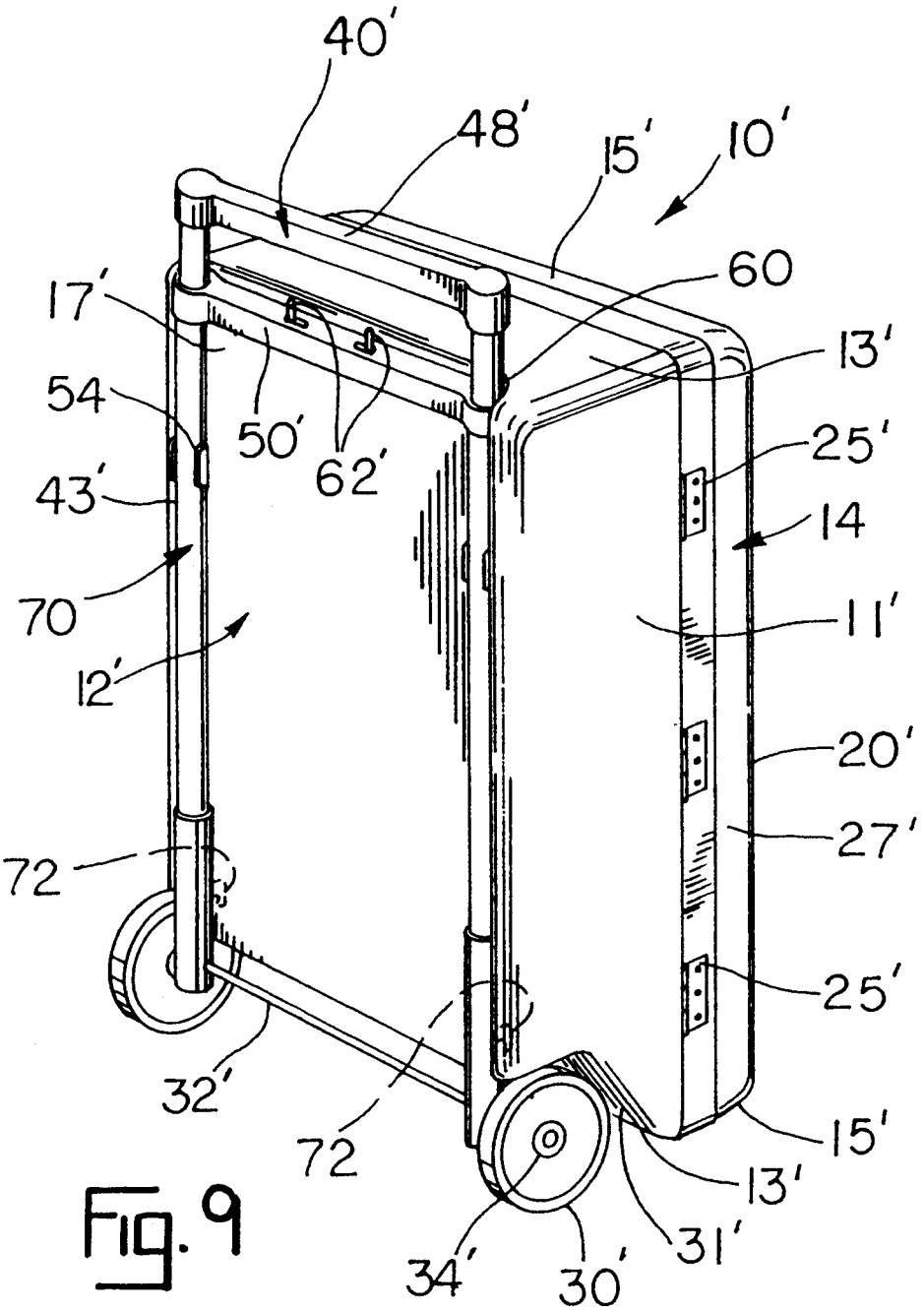
FIG. 9 is a side and bottom perspective view of a second embodiment of a carry-on case with its lid in a closed position and with the wheel and handle assembly intact and with the handle in its lowered position.
Figure 10:
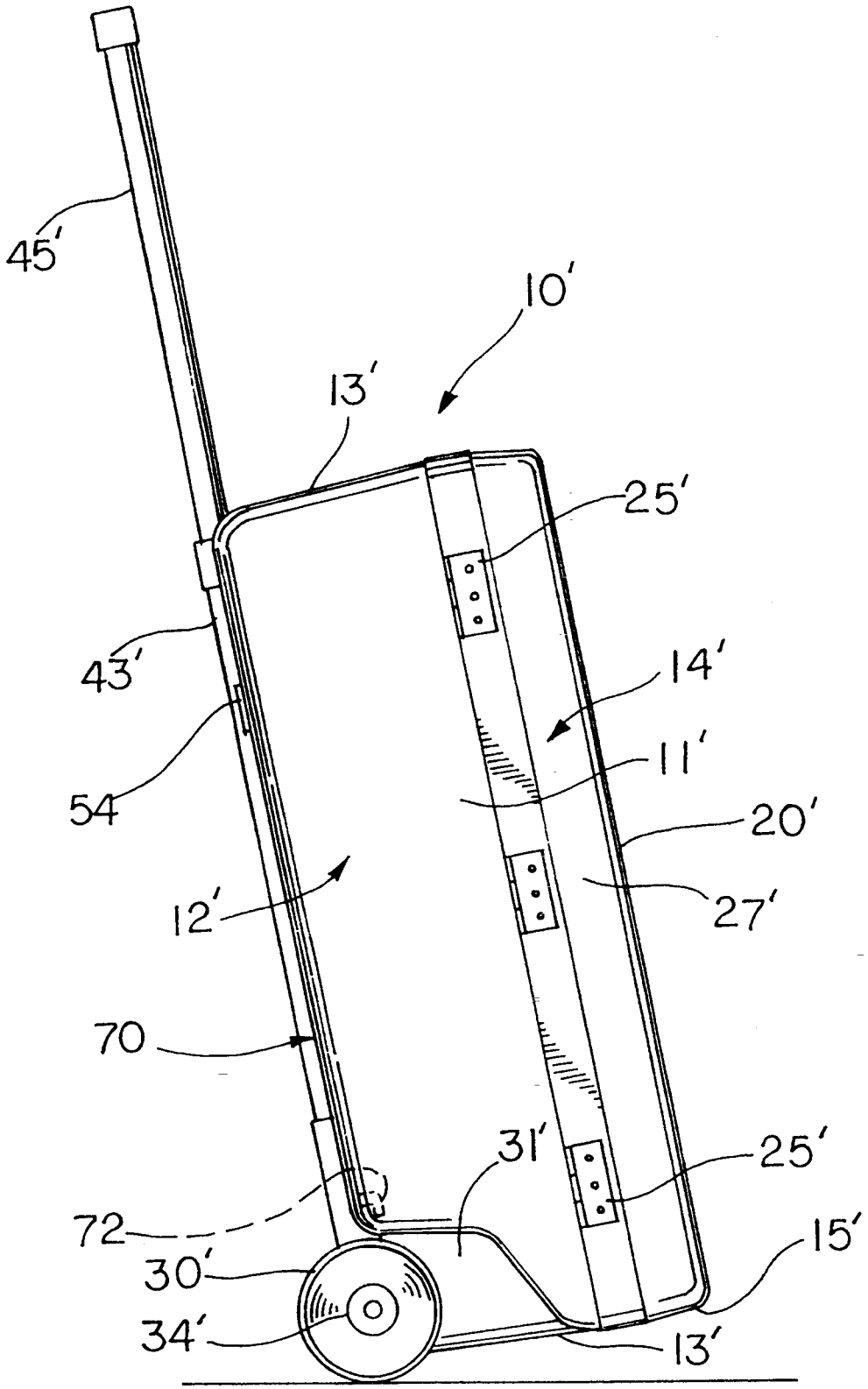
FIG. 10 is an elevational view of the carry-on case of FIG. 9 with the handle in its extended position.
Figure 11:
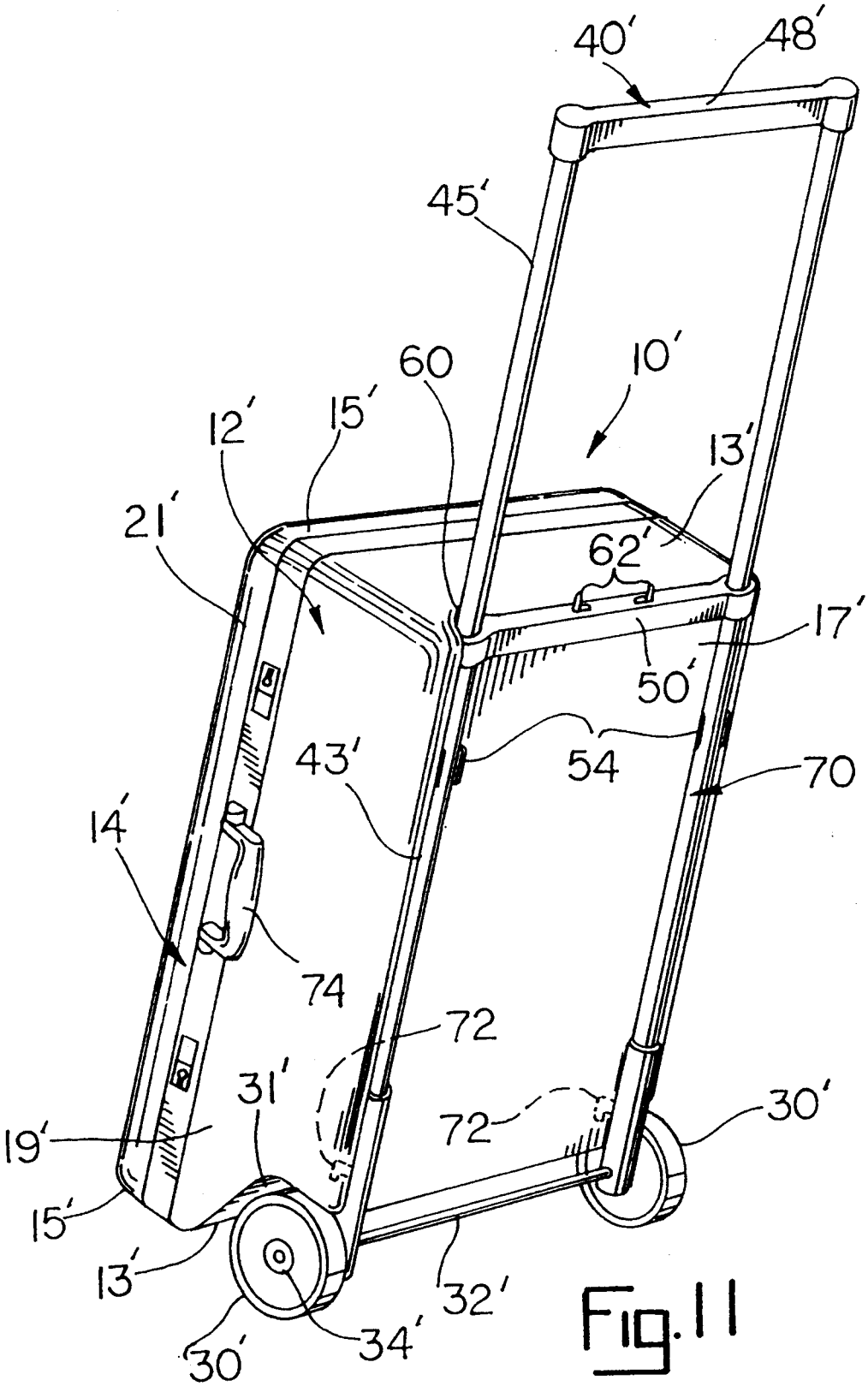
FIG. 11 is a rear perspective view of the carry-on case of FIG. 10.
Figure 12:
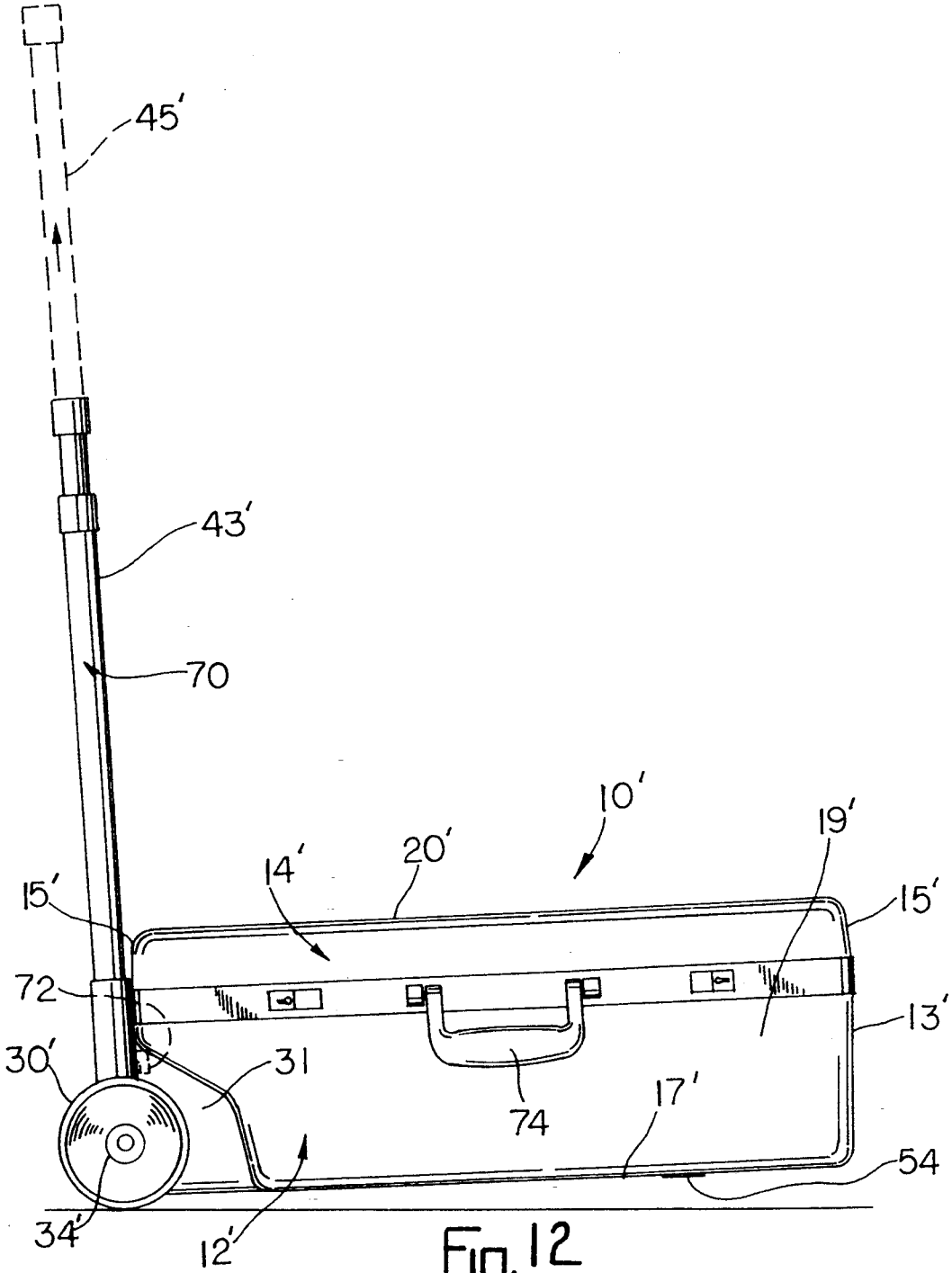
FIG. 12 is a side elevational view of the carry-on case of FIG. 9 with the wheel and handle assembly relocated.

Assembly 70 is selectively secured by means of locking hooks 72 in either the tow position of FIGS. 9–11 or the lift position of FIG. 12.

Assembly 70 is selectively secured in the tow position shown in FIGS. 9–10 by having lock hooks 72 snugly inserted into the lock holes within channel 60 of base bottom wall 17' with the hooks engaging the bottom wall. This prevents the outer telescopic members 43' of handle 40' from sliding longitudinally relative to base 12' or from being separated from the base at axle member 32'. Assembly 70 is further secured to base 12' by telescopic members 43' being held within channels 60 by spring clamps 54.

FIGS. 10 and 11 show handle 40' in its extended position to allow towing. FIG. 9 illustrates case 10' with handle 40' in its collapsed position to allow case 10' to be carried either by hand grip 48' or by handle 74.

To achieve the truck or lift position as shown in FIG. 12, it is necessary to detach assembly 70 from its position shown in FIGS. 9–11. Assembly 70 is reattached and locked in its lift position. Luggage composed of several suitcases can be stacked upon the closed lid 14' and can rest against extended handle 40'. For the lift position shown in FIG. 12, the locking hook system is used in a manner similar to that previously described. Two slotted lock holes are located in end wall 13' of base 12' of case 10'. Assembly 70 is secured in its lift position by having lock hooks 72 snugly inserted into the two lock holes in end wall 13'. Lock hooks 70 are pivoted downwardly into the lock holes over the end wall which prevents base 12' which rests against outer telescopic members 43' from pivoting forwardly. As seen in FIG. 12, the upper edges of the case about the lock holes rest upon the top ledges of hooks 72 with the hooks extending around the lower edges of the lock holes to retain the case in elevated position. In this lift position, the case base and closed lid can be tilted upon wheels 30' located at each side of the base.

Case 10'' illustrated in FIGS. 13–19 includes a housing formed by a base 12'' and a lid 14'' which are connected together by hinges 25''. Base 12'' of case 10'' includes a bottom wall 17'', two end walls 13'', a rear wall 11'', and a front wall 19''. Bottom wall 17'' includes two cutaway parallel recessed channels 75. A U-shaped spring clamp 76 is secured within each channel 75 Lid 14'' includes a top wall 20'', two end walls 15'', a rear wall 27'', and a front wall 21''. Case 10'' also includes a wheel and handle assembly 80 that are detachable and reattachable in two different positions on base 12''.

Assembly 80 has two wheels 30''. Wheels 30'' are journalled upon an axle member 32''. Axle member 32'' extends through each wheel 30'' at its center with the wheel being retained upon the axle member by press-fitted retainer cups 34''. Assembly 80 includes a handle 40'' that is extendable and collapsable. Handle 40'' of assembly 80 includes two parallel side rails. Each side rail includes an outer telescopic member 43'' and an inner telescopic member 45''. Outer telescopic members 43'' are joined at corresponding ends by a cross-brace 50''. Axle member 32'' extends through the opposite corresponding ends of members 43''. A hand grip 48'' with pins 62'' is connected to inner telescopic members 45'' of the handle. Movement of handle 40'' between its extended position (as seen in FIGS. 14 and 15, and in broken lines in FIG. 16) and its collapsed position (as seen in FIG. 13) as well as its securement to the lid is accomplished in the same manner as described above for case 10 of FIGS. 1–8.

Figure 13:
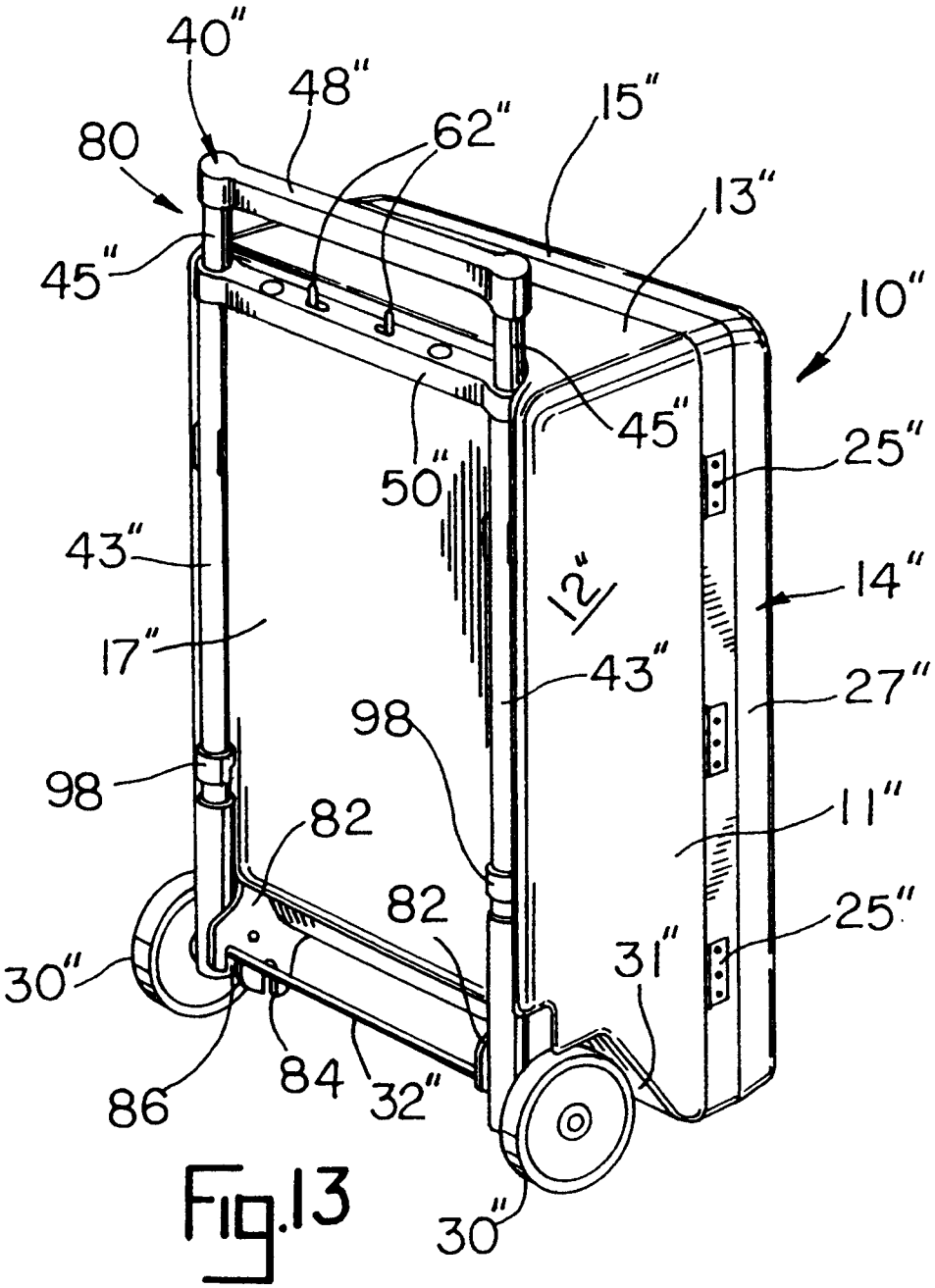
FIG. 13 is a side and bottom perspective view of a third embodiment of a carry-on case with its lid in a closed position and with the wheel and handle assembly intact, and with the handle in its lowered position and a wheel in fragmented form for illustrative purposes.
Figure 14:
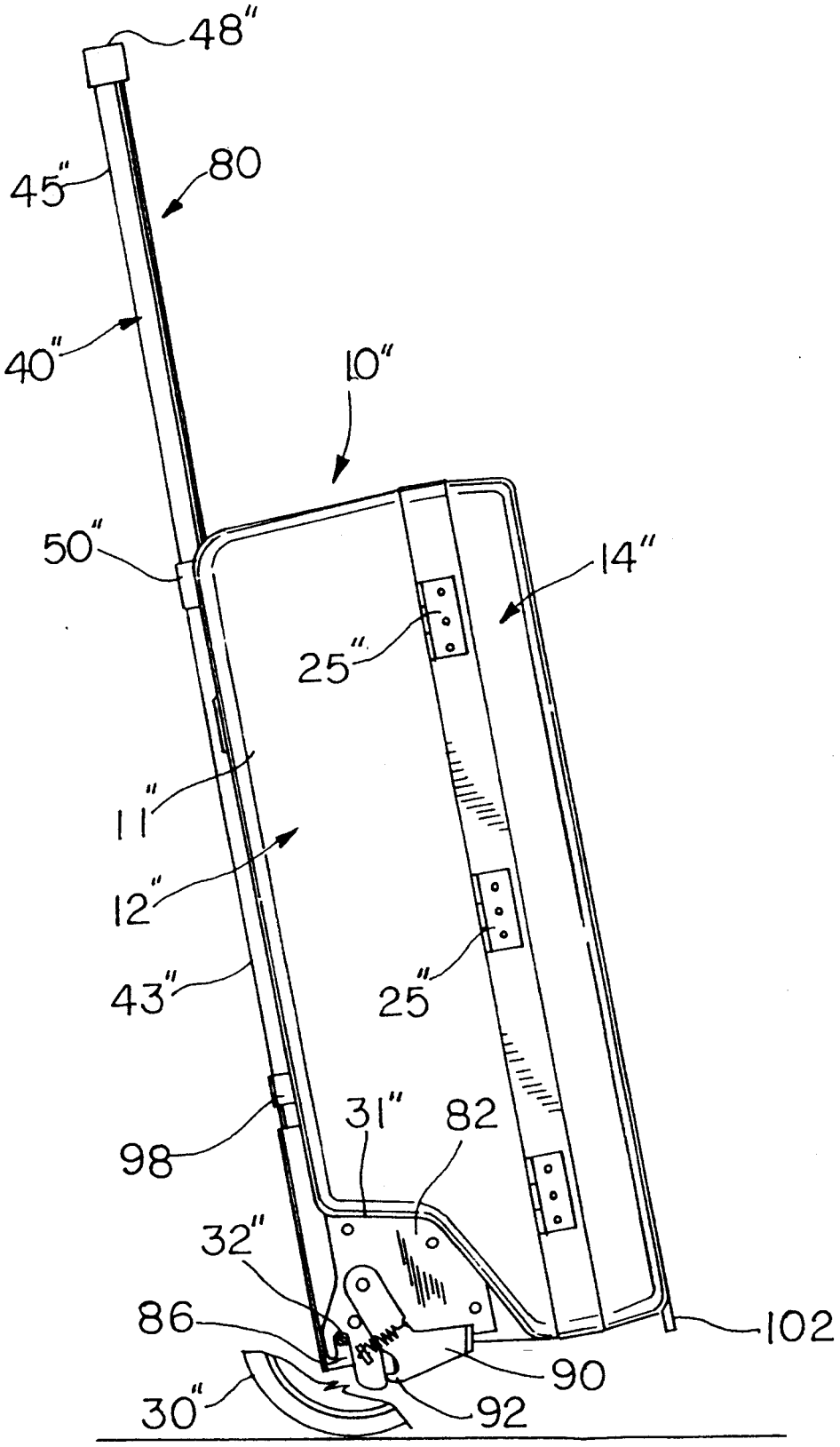
FIG. 14 is an elevational view of the carry-on case of FIG. 13 with the handle in its extended position.
Figure 15:
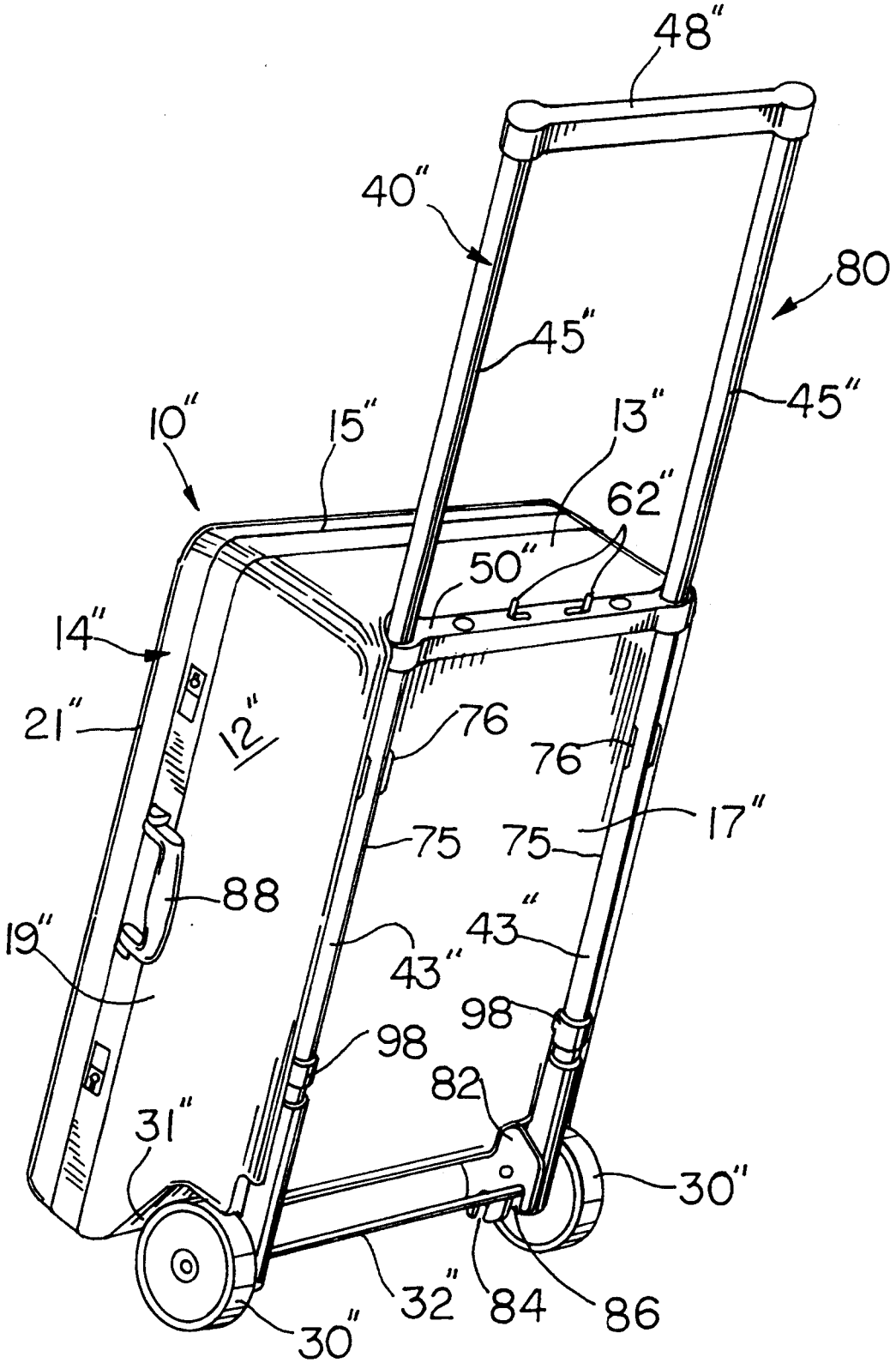
FIG. 15 is a rear perspective view of the carry-on case of FIG. 14.
Figure 16:
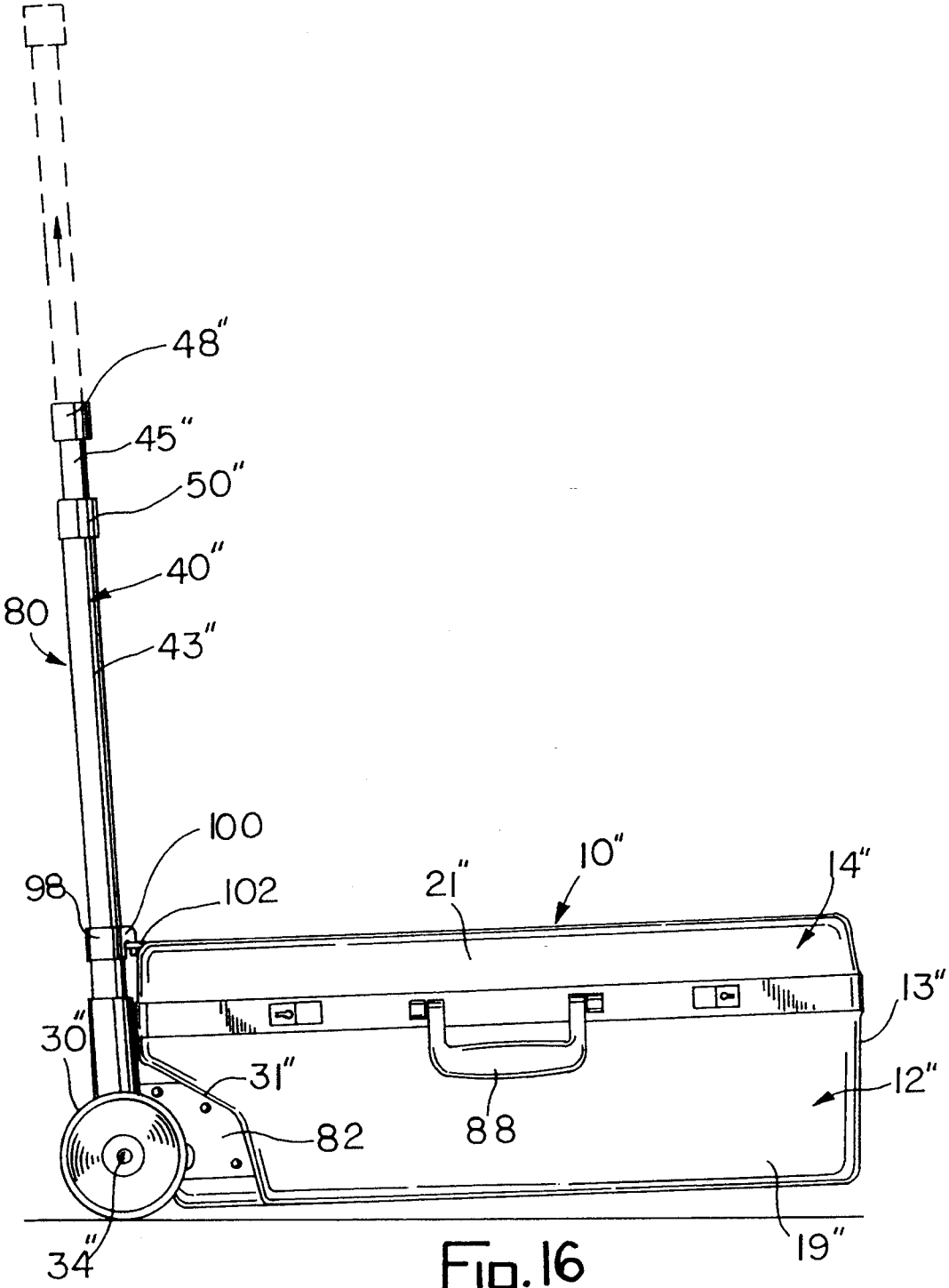
FIG. 16 is a side elevational view of the carry-on case of FIG. 13 with the wheel and handle assembly relocated.
Figure 17:
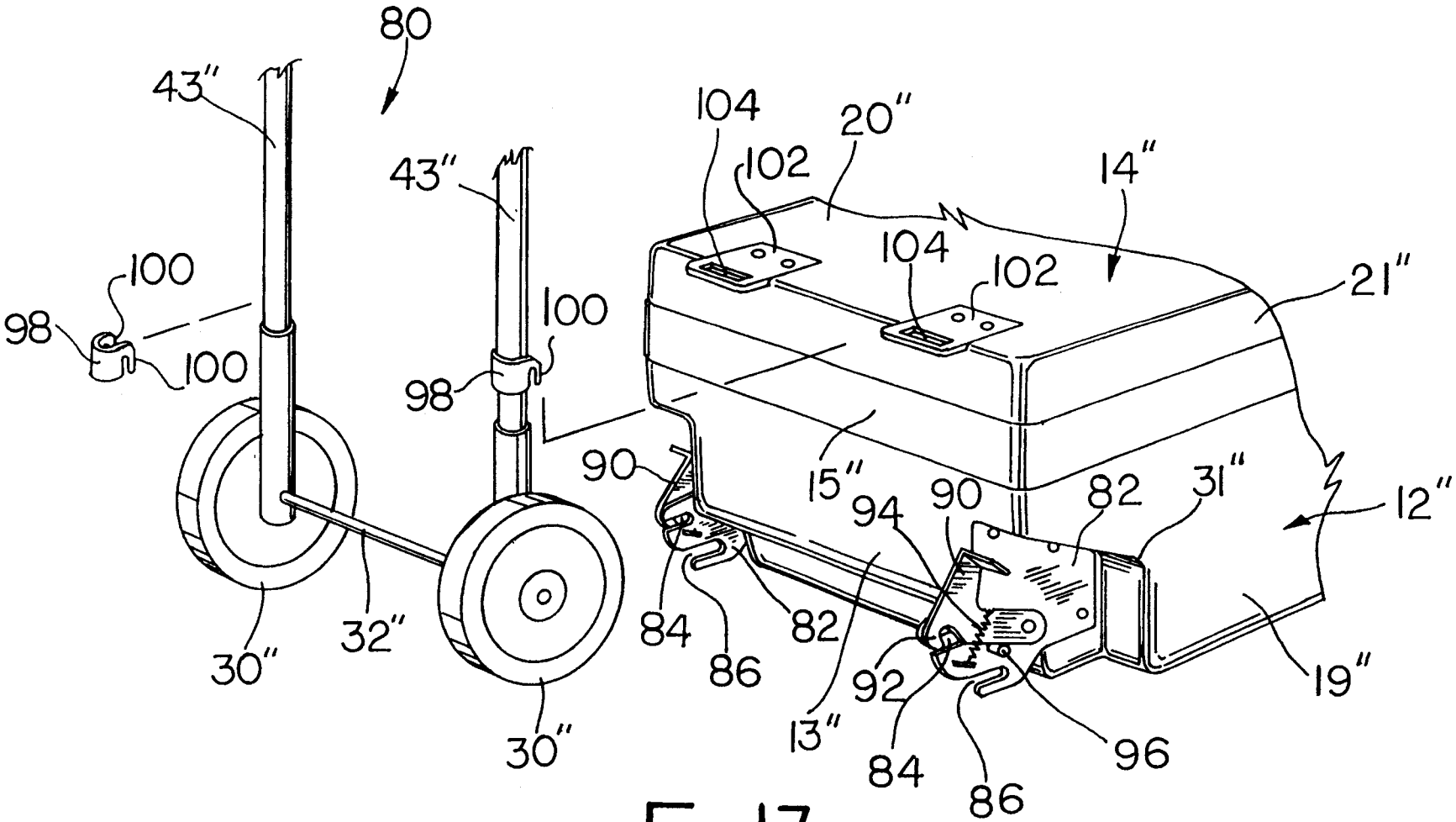
FIG. 17 is a fragmentary view of the carry-on case of FIG. 13 with the wheel and handle assembly separated from the case.
Figure 19:
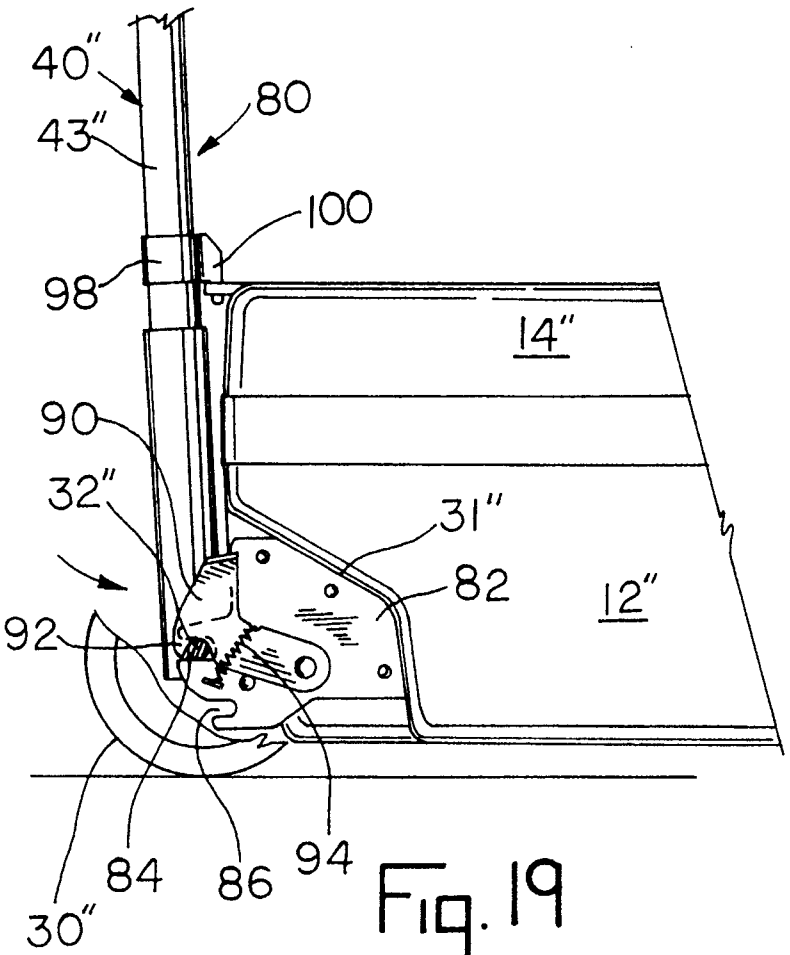
FIG. 19 is a fragmentary side elevational view showing the wheel and axle assembly in sequential operating form from FIG. 18 and with the wheel and axle assembly in secured and locked position relative to the case.

Assembly 80 can be selectively secured in the tow position shown in FIGS. 13–15 or the lift position of FIGS. 16 and 19. To secure assembly 80 in its tow position as shown in FIGS. 13–15, a latch plate 82 is secured to each base wall 11'' and 19'' within the wheel accomodating indentations 31'' formed in the walls. Each plate 82 includes an upper rearwardly opening slot 84 and a lower rearwardly opening slot 86. Each slot 86 of latch plates 82 are located in the same general plane as bottom wall 17'' of base 12'' during carrying or towing. Assembly 80 is secured in its tow position by having axle member 32'' fitted into latch plate slots 86 with handle 40'' being pivoted about the axle member towards base bottom wall 17'' until outer telescopic members 43'' of the handle enter channels 75 in the bottom wall and are engaged and retained by spring clamps 76. Clamps 76 provide sufficient clamping strength to secure the handle against lateral movement relative to base 12''. With handle 40'' so secured to base 12'', case 10'' can be carried either in the vertical orientation shown in FIG. 13 by hand grip 48'' of the handle with the telescopic members thereof being secured in their retracted positions or the case may be carried by the handle 88 secured to the front wall 19'' of the base. Additionally, handle 40'' may be extended such as shown in FIG. 15 to allow the case to be towed with wheels 30'' serving to support the case upon the floor or ground.

Each lock plate 82 carries a pivotally connected latch 90, having a hook part 92. A helical spring 94'' connected between latch 90 and plate 82 so as to draw the latch against a stop 96 at which hook part 92 of the latch covers the opening into upper slot 84 in the lock plate. A clip 98 is located upon and carried by each outer telescopic member 43'' of handle 40''. Each clip 98 includes a pair of depending lock tabs 100. Attached to lid 14'' upon top wall 20'' of the case are two securement plates 102. Plates 102 are located at the end of the case 10'' where lock plates 82 are located and project slightly beyond the edge of lid 14". Each securement plate 102 has a slotted opening 104 formed in it.

Figure 18:
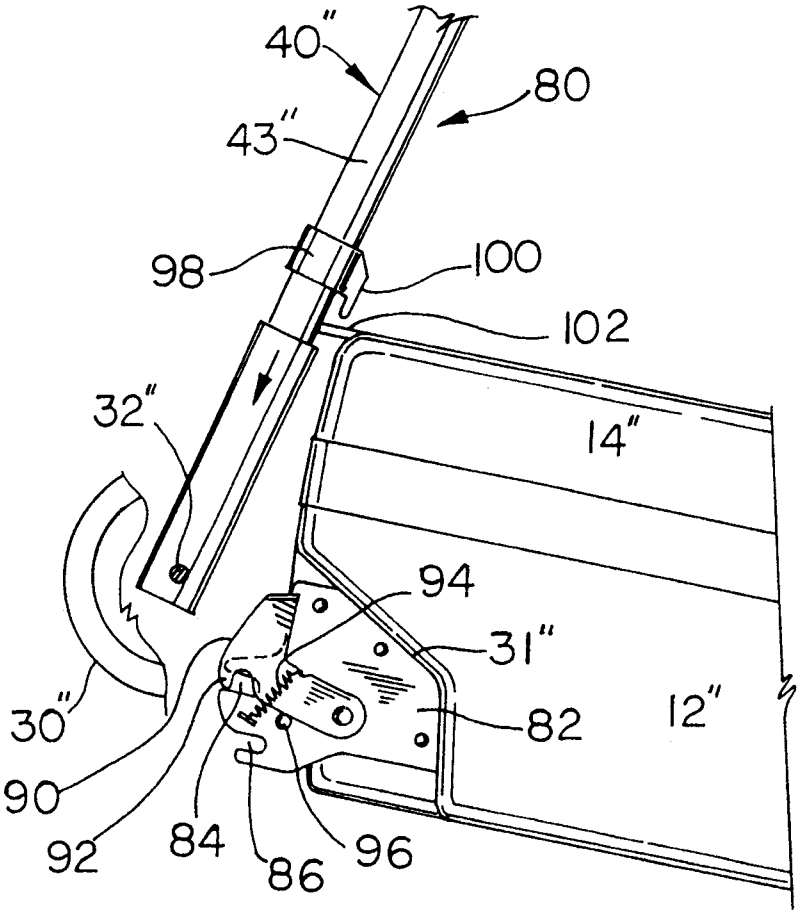
FIG. 18 is a fragmentary side elevational view showing the wheel and axle assembly of the case of FIG. 13 being connected to the case.

Having described the components of case 10" by which assembly 80 can be secured to base 12", the manner in which the connection is accomplished will now be explained. Referring to FIGS. 18 and 19, assembly 80 is first connected to lid 14" by having tabs 100 of the handle carried clips 98 fitted into openings 104 of plates 102. With the handle so connected to the case lid, assembly 80 is pivoted toward base 12" with axle member 32" of the assembly entering the upper slot 84 of each lock plate 82 causing latch 90 to be cammed upwardly against the tension of spring 94 until the axle is sufficiently seated within the slot to allow latch 90 to be drawn by the spring downward with its hook part 92 engaging the axle as illustrated in FIG. 19. In this manner, handle assembly 80 is secured to base 12". Wheels 30" overlie the exteriors of lock plates 82. With the handle assembly so connected, the case base 12" and closed lid 14" can be tilted upon wheels 30" to allow the case to be utilized with its handle extended as a lift device. Luggage which may consist of several suitcases can be stacked upon closed lid 14" and rest against the extended handle 40". This lift position of the case is illustrated in FIG. 16 with the handle being shown in its retracted position in solid lines and in its extended position in broken lines.

To detach assembly 80 from the remainder of the case, each latch 90 need only be raised to free its hook part 92 from the handle assembly axle member 32", allowing the assembly to be pivoted toward the base and lid which frees the axle member from slots 84 in lock plates 82. After the axle member 32" of assembly 80 has cleared slots 84 of the lock plates, the handle assembly may be lifted, freeing clip tabs 100 from plates 102. The handle assembly 80, with its handle collapsed, may then be reattached to base 12", as previously described, in its stored location as shown in FIG. 13. When in this position, clips 98 extend into channels 75 in base bottom wall 17".

It is understood that the above description does not limit the invention to those details above given. Such a description may be modified within the scope of the following claims.

We claim:

1. A carrying case comprising housing formed by a base and an upper lid, a hinge member connecting said lid to said base for shiftable movement between an open position exposing the interior of said base and a secured closed position overlying the base, a separate wheel and handle assembly including wheels and a handle, said wheels being rotatively connected to said handle, said assembly having a first position with its said wheels located adjacent an end of the housing and its said handle extending along the housing generally parallelling said lid, securement means releasably connecting said assembly to said housing for enabling said base and said lid when in its said closed position to be towed upon the wheels by pulling upon the handle, said assembly having a second position with its said wheels located adjacent an end of the housing and its said handle extending upwardly above the housing generally perpendicular to said lid, said securement means releasable connecting said assembly to said housing for enabling the lid to be used as an article support with the base tilted by the handle upon said wheels.

2. The carrying case of claim 1 wherein said securement means includes a clamp means for releasably engaging said handle when said assembly is secured to the housing in its first position.

3. The carrying case of claim 2 wherein said clamp means is carried by said lid.

4. The carrying case of claim 1 wherein said securement means is carried in part by said base and in part by said lid.

5. The carrying case of claim 4 wherein said securement means includes a .plate attached to said base, said plate having slot means for receiving said assembly in either its first or second position.

6. The carrying case of claim 5 wherein said plate slot means includes a slot having an opening covered by a releasible latch, said assembly wheels being supported by an axle, said axle fitted into said slot and secured therein by said latch, said handle releasably secured to said housing.

7. The carrying case of claim 6 wherein said axle is so secured by said latch when said assembly is in its second position.

8. The carrying case of claim 7 wherein said plate slot means includes a second slot, said axle fitted into said second slot when said assembly is in its first position with said handle secured to said housing.

* * * * *